US011578955B2

(12) United States Patent
Sanner et al.

(10) Patent No.: US 11,578,955 B2
(45) Date of Patent: Feb. 14, 2023

(54) LIGHTWEIGHT AMMUNITION ARTICLES COMPRISING A POLYMER CARTRIDGE CASE

(71) Applicant: SHPP Global Technologies B.V., Bergen Op Zoom (NL)

(72) Inventors: Mark A. Sanner, Evansville, IN (US); Ernest Ford Caldwell, Dunwoody, GA (US); Charles Padgett, Vero Beach, FL (US); Christopher Wall, Dalton, MA (US); Gerould Harding, Pittsfield, MA (US); Lanse Padgett, Vero Beach, FL (US)

(73) Assignee: SHPP GLOBAL TECHNOLOGIES B.V., Bergen Op Zoom (NL)

( * ) Notice: Subject to any disclaimer, the term of this patent is extended or adjusted under 35 U.S.C. 154(b) by 12 days.

(21) Appl. No.: 17/264,599

(22) PCT Filed: Jul. 26, 2019

(86) PCT No.: PCT/US2019/043617

§ 371 (c)(1),
(2) Date: Jan. 29, 2021

(87) PCT Pub. No.: WO2020/028163

PCT Pub. Date: Feb. 6, 2020

(65) Prior Publication Data

US 2021/0231420 A1 Jul. 29, 2021

Related U.S. Application Data

(60) Provisional application No. 62/760,619, filed on Nov. 13, 2018, provisional application No. 62/711,958, filed on Jul. 30, 2018.

(51) Int. Cl.
*F42B 5/307* (2006.01)

(52) U.S. Cl.
CPC ..... *F42B 5/307* (2013.01)

(58) Field of Classification Search
CPC .... F42B 5/26; F42B 5/30; F42B 5/307; F42B 5/313
See application file for complete search history.

(56) References Cited

U.S. PATENT DOCUMENTS 3,745,924 A * 7/1973 Scanlon ..... F42B 5/307 102/467
7,610,858 B2 11/2009 Chung
(Continued)

FOREIGN PATENT DOCUMENTS

WO WO-2006094987 A1 * 9/2006 ..... C08L 65/02
WO WO-2006094988 A2 * 9/2006 ..... C08L 65/02
(Continued)

OTHER PUBLICATIONS

International Search Report for International Application No. PCT/US2019/043617, International Filing Date Jul. 26, 2019, dated Oct. 4, 5 pages.
(Continued)

*Primary Examiner* — Jonathan C Weber
(74) *Attorney, Agent, or Firm* — Cantor Colburn LLP

(57) ABSTRACT

An ammunition article comprises a polymer cartridge case formed of a polymer composition comprising a thermoplastic polymer, preferably the polymer composition having a density of less than 1.35 determined in accordance with ASTM D792, the polymer cartridge case having a first end, an opposing second end, and a chamber disposed between the first end and the second end for receiving a propellant; a projectile attached to the first end of the polymer cartridge case; a metal base insert joined to the second end of the polymer cartridge case; and a primer carried by the metal base insert; wherein the metal base insert and the polymer cartridge case remain joined together as a single piece
(Continued)

assembly upon loading, firing and removal from a chamber of a firearm for a polymer case temperature of −65° F. (−54° C.) to 165° F. (74° C.).

19 Claims, 3 Drawing Sheets

(56) References Cited

U.S. PATENT DOCUMENTS

| | | | | |
|---|---|---|---|---|
| 8,240,252 | B2 | 8/2012 | Maljkovic et al. | |
| 8,813,650 | B2 | 8/2014 | Maljkovic et al. | |
| 9,296,894 | B2 * | 3/2016 | Wang | C08L 69/005 |
| 9,335,137 | B2 * | 5/2016 | Maljkovic | F42B 5/26 |
| 9,964,388 | B1 * | 5/2018 | Burrow | F42B 5/307 |
| 2006/0207464 | A1 * | 9/2006 | Maljkovic | F42B 5/313 102/466 |
| 2007/0261587 | A1 * | 11/2007 | Chung | F42B 5/313 102/466 |
| 2009/0069489 | A1 * | 3/2009 | Vollenberg | C08L 69/00 264/572 |
| 2012/0111219 | A1 * | 5/2012 | Burrow | F42B 5/02 102/466 |
| 2014/0060373 | A1 * | 3/2014 | Maljkovic | F42B 5/30 102/466 |
| 2014/0076188 | A1 * | 3/2014 | Maljkovic | F42B 5/025 102/467 |
| 2014/0329920 | A1 * | 11/2014 | Rosenquist | C08L 69/00 521/134 |
| 2015/0316361 | A1 * | 11/2015 | Maljkovic | F42B 5/025 102/466 |
| 2016/0003588 | A1 * | 1/2016 | Burrow | F42C 19/0807 102/466 |
| 2016/0003601 | A1 * | 1/2016 | Burrow | C22C 33/0285 102/467 |
| 2016/0025464 | A1 * | 1/2016 | Maljkovic | F42B 33/10 102/466 |
| 2016/0033241 | A1 * | 2/2016 | Burrow | C22C 38/02 102/466 |
| 2016/0349022 | A1 * | 12/2016 | Burrow | F42B 5/26 |
| 2016/0349028 | A1 * | 12/2016 | Burrow | F42B 5/307 |

FOREIGN PATENT DOCUMENTS

| | | | | |
|---|---|---|---|---|
| WO | WO-2007101857 | A2 * | 9/2007 | C08J 5/043 |
| WO | 2013016730 | A1 | 1/2013 | |

OTHER PUBLICATIONS

Written Opinion for International Application No. PCT/US2019/043617, International Filing Date Jul. 26, 2019, dated Oct. 4, 11 pages.

* cited by examiner

LIGHTWEIGHT AMMUNITION ARTICLES COMPRISING A POLYMER CARTRIDGE CASE

CROSS REFERENCE TO RELATED APPLICATIONS

This application is a National Stage application of PCT/US2019/043617, filed Jul. 26, 2019, which claims the benefit of U.S. Provisional Application No. 62/760,619, filed Nov. 13, 2018, and U.S. Provisional Application No. 62/711,958, filed Jul. 30, 2018, all of which are incorporated by reference in their entirety herein.

BACKGROUND

This disclosure relates to ammunition articles, and in particular to lightweight ammunition articles comprising a polymer casing.

Small arms ammunition cartridges are used in a variety of firearms ranging from pistols to rifles and shotguns to heavier automatic weapons. Ammunition cartridges typically include a case, a bullet, a case primer, and a propellant or gunpowder. Some ammunition cases use aluminum or steel, however, nearly all conventional ammunition cases are made of brass alloy. There is a need by the Military to reduce the weight of ammunition to lessen the load a soldier carries into combat without sacrificing performance and operational capabilities of brass. Compared to brass, polymers are lightweight. However, there are numerous obstacles, which prevent polymeric materials from working as a drop-in replacement for brass with the greatest being the temperature range for which it must function. In particular, the low temperature requirement of −40° F. (−40° C.) has been one of the challenging technological barriers for polymers to overcome. There accordingly remains a need in the art for lightweight ammunition articles that can function properly in a wide operating temperature range.

SUMMARY

An ammunition article comprises a polymer cartridge case formed of a polymer composition comprising a thermoplastic polymer, preferably the polymer composition having a density of less than 1.35 determined in accordance with ASTM D792, the polymer cartridge case having a first end, an opposing second end, and a chamber disposed between the first end and the second end for receiving a propellant; a projectile attached to the first end of the polymer cartridge case; a metal base insert joined to the second end of the polymer cartridge case; and a primer carried by the metal base insert; wherein the metal base insert and the polymer cartridge case remain joined together as a single piece assembly upon loading, firing and removal from a chamber of a firearm for a polymer case temperature of −65° F. (−54° C.) to 165° F. (74° C.).

BRIEF DESCRIPTION OF THE DRAWINGS

A description of the figures, which are meant to be exemplary and not limiting, is provided in which:

FIG. 2B is a side view of the cartridge body of FIG. 2A;

FIG. 2C is a cross-sectional view along line A-A of the cartridge body of FIG. 2B;

DETAILED DESCRIPTION

The inventors hereof have discovered polymeric lightweight ammunition articles achieving the operational requirements equivalent to the incumbent material (brass). In particular, the lightweight ammunition articles having a polymer cartridge case formed of polymer compositions that have a balance of strength, stiffness and ductility at high strain rates over a wide temperature range for which other materials do not. Ammunition articles having a cartridge made from such polymer compositions can have a high successful rate in firing events for different ammunition article calibers and at a wide operating temperature range. With the discovery it is now possible to manufacture ammunition articles having a weight reduction up to 30% yet having comparable performances as the conventional brass cartridges.

Figure 1:
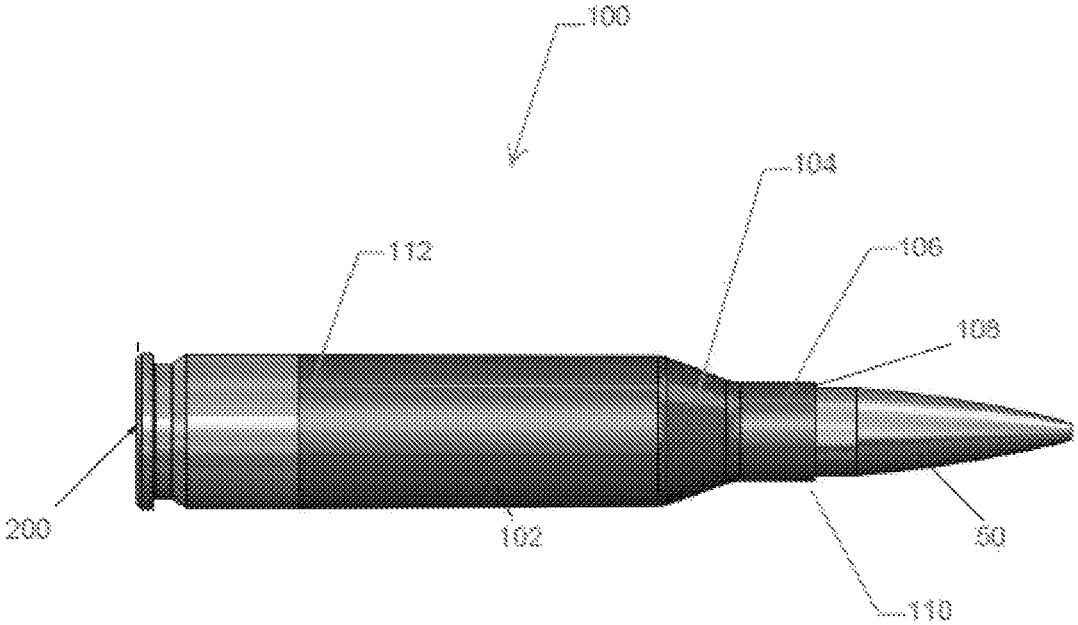
FIG. 1 is a side elevation sectional view of a bullet and cartridge in accordance with an example of the invention.

Referring now to FIG. 1, an example of a cartridge 100 for a polymer ammunition article has a cartridge case 102 which transitions into a shoulder 104 that tapers into a neck 106 having a mouth 108 at a first end 110. The mouth 108 can be releasably connected to, in a conventional fashion, to a bullet or other weapon projectile 50. The cartridge case can be made from a plastic material, for example a suitable polymer. The rear end 112 of the cartridge case is connected to a base 200.

Figure 2A:
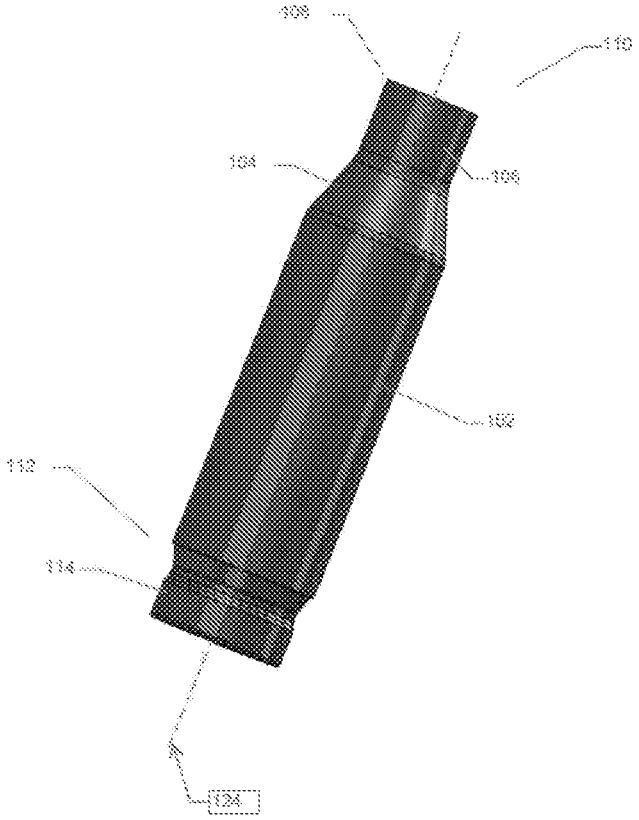
FIG. 2A is a perspective view of the cartridge body in accordance with an example of the invention.

FIGS. 2A-2C illustrate the cartridge case 102 without the projectile 50 or base 200. FIGS. 2A-2C illustrate the base interface portion 114 positioned at the rear end 112 which provides the contact surface with the base insert 200. This is described in detail below. FIG. 2B illustrates that the case 102 from the front of the front end 110 to the rear of the rear end 112 has a length L1. The base interface portion 114 has a length L2.

FIG. 2C illustrates a cross-section of the case 102 along line A-A. Here, the majority of the case 102 forms a propellant chamber 116. The propellant is typically a solid chemical compound in powder form commonly referred to as smokeless powder. Propellants are selected such that when confined within the cartridge case 100, the propellant burns at a known and predictably rapid rate to produce the desired expanding gases. The expanding gases of the propellant provide the energy force that launches the bullet from the grasp of the cartridge case and propels the bullet down the barrel of the gun at a known and relatively high velocity. The volume of the propellant chamber 116 determines the amount of powder, which is a major factor in determining the velocity of the projectile 50 after the cartridge 100 is fired. The volume of the propellant chamber 116 can be decreased by increasing a case wall thickness Tc or adding a filler (not illustrated). The type of powder and the weight of the projectile 50 are other factors in determining projectile velocity. The velocity can then be set to move the projectile at subsonic or supersonic speeds.

Figure 3A:
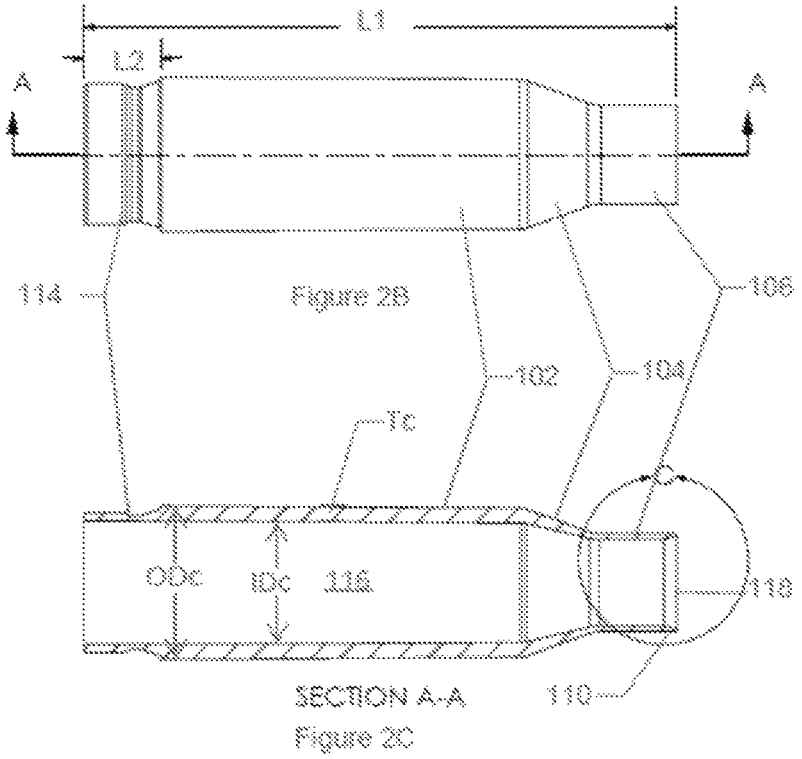
FIG. 3A is a perspective view of the body insert in accordance with an example of the invention.
Figure 3A:
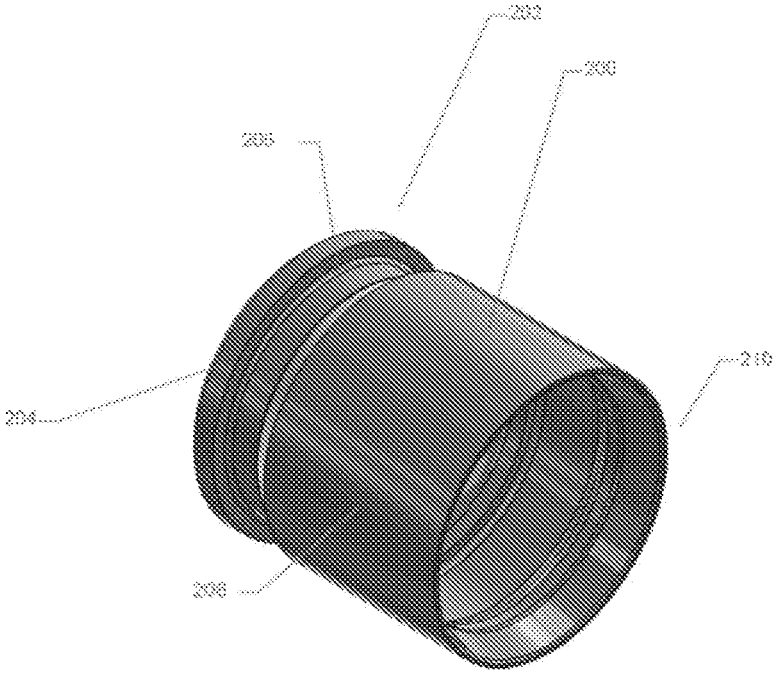
Figure 3B:
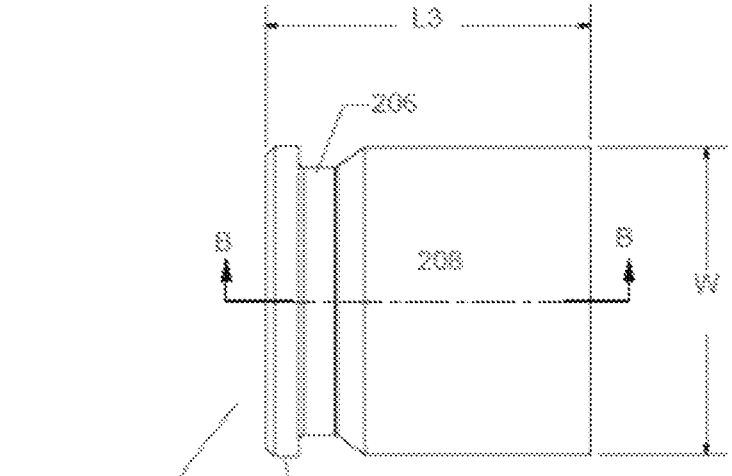
FIG. 3B is a side view of the body insert of FIG. 3A.
Figure 3C:
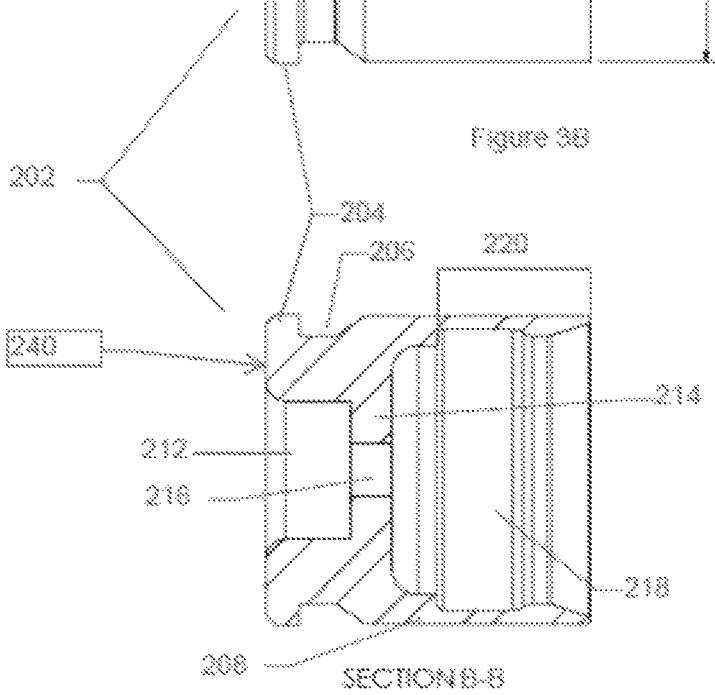
FIG. 3C is a cross-sectional view along line B-B of the cartridge body of FIG. 3B.

FIGS. 3A-3C illustrate the base/insert 200 separate from the cartridge case 102 and the projectile 50. The base 200 has a rear end 202 with an enlarged extraction lip 204 and groove 206 just in front to allow extraction of the base 200 and cartridge 100 in a conventional fashion. An annular cylindrical wall 208 extends forward from the rear end 202 to the front end 210. FIG. 3C illustrates a primer cavity 212 located at the rear end 202 and extends to a radially inwardly extending ledge 214 axially positioned intermediate the rear end 202 and front end 210. A reduced diameter passage 216, also known as a flash hole, passes through the ledge 214. The cylindrical wall 208 defines an open ended main cavity 218 from the ledge 214 to open front end 210. The primer cavity 212 and flash hole 216 are dimensioned to provide enough structural steel at annular wall 208 and ledge 214 to withstand any explosive pressures outside of the gun barrel.

FIG. 3B illustrates the base length L3 from rear to front ends 202, 210. As will be described, only a portion of the base length L3 of the insert 200 engages with the base interface portion 114 along its length L2. The case interface portion 220 is shaped to interface with the case's 102 base interface portion 114. The case 102 and the base 200 are "snapped", friction fit, or interference fit together. Said another way, the insert 200 and the case 102 can be interlocked. This can occur before or after both pieces are formed. FIG. 3B illustrates an interlocking design which can have the polymer base interface portion 114 "inside" the insert 200, i.e. the portion defined by length L2, and at that only the insert wall 208 is exposed. The insert 200, in this example, is not overmolded. Thus, the width W, or outer diameter, of the insert 200 approximately matches an outer diameter of the case 102 at that point (i.e., ODc) once assembled. The present invention includes a slightly oversized polymer body such that when the metal case expands during firing, that the polymer portion maintains its interlock.

As discussed herein, the cartridge case is formed of a polymer composition having a unique combination of strength, stiffness and ductility at high strain rates over a wide temperature range.

The polymer compositions can have good tensile elongation at break at low temperatures and high strain rates. In an embodiment, the polymer compositions have a tensile elongation to break of greater than 60% at a strain rate of 480 mm/min (millimeter per minute), a tensile elongation to break of greater than 50% at a strain rate of 4800 mm/min, and/or a tensile elongation to break of greater than 40% at a strain rate of 48000 mm/min, each determined in accordance with ASTM D638-08 at −40° F. (−40° C.) on an ASTM type V tensile bar.

The polymer compositions can also have good tensile elongation at break at elevated temperatures and high strain rates. In an embodiment, the polymer compositions have a tensile elongation to break of greater than 150% at a strain rate of 480 mm/min, a tensile elongation to break of greater than 100% at a strain rate of 4800 mm/min, and/or a tensile elongation to break of greater than 70% at a strain rate of 48000 mm/min, each determined in accordance with ASTM D638-08 at 165° F. (74° C.) on an ASTM type V tensile bar.

At a strain rate of 480 mm/min, the polymer compositions can exhibit a tensile yield strength of greater than 9,000 psi (pounds per square inch) at −40° F. (−40° C.); a tensile yield strength of greater than 7,000 psi at 74° F. (23° C.); and/or a tensile yield strength of greater than 5,000 psi at 165° F. (74° C.), each determined in accordance with ASTM D638-08 on an ASTM type V tensile bar.

The polymer compositions can also have good tensile modulus at high strain rates over a wide temperature range. In an embodiment, at a strain rate of 480 mm/min, the polymer compositions have a tensile modulus of greater than 300,000 psi at −40° F. (−40° C.); a tensile modulus of greater than 220,000 psi at 74° F. (23° C.); or a tensile modulus of greater than 180,000 psi at 165° F. (74° C.), each determined in accordance with ASTM D638-08 on an ASTM type V tensile bar.

The polymer compositions are impact resistant and ductile at low temperatures. In an embodiment, the polymer compositions have at least 80% of ductility, at least 90% ductility, or 100% ductility, determined in accordance with ASTM D256 with a 0.125 inch (3.18 mm) thickness test specimen and 5.5 lbf/ft pendulum at −40° F. (−40° C.) to 32° F. (0° C.). The polymer compositions can have a notched izod impact value of greater than 8 ft-lbf/in at 74° F. (23° C.), determined in accordance with ASTM D256-10 standard test method with a 0.125 inch (3.18 mm) thickness test specimen and a pendulum energy of 5.5 lbf/ft. The polymer compositions can also have a notched izod impact value of greater than 5 ft-lbf/in or greater than 8 ft-lbf/in at −65° F. (−55° C.) determined in accordance with ASTM D256-10 standard test method with a 0.125 inch (3.18 mm) thickness test specimen and a pendulum energy of 5.5 lbf/ft.

The polymer compositions can have a storage modulus change of less than 45% from −65° F. (−54° C.) to 65° F. (74° C.) at a heating rate of 20° C. per minute as measured using a Dynamic Mechanical Analyzer in accordance with ASTM D5026 on an izod impact bar.

The polymer compositions can have a heat deflection temperature of greater than 230° F. (110° C.) determined in accordance with ASTM D648 at 264 psi (1.8 MPa) with a un-annealed sample having a thickness of 0.125 inch (3.18 mm). This indicates that the polymer cartridge formed from the polymer compositions can be used at elevated temperatures such as 165° F. (74° C.) without deformation.

The polymer compositions have good flow properties, which aids processing. The polymer compositions as disclosed herein have a melt flow rate of greater than 6 grams per 10 minutes (g/10 min), preferably 6 to 15 g/10 min, determined in accordance with ASTM D1238 under a load of 1.2 kg at 300° C. The melt flow rate of the polymer compositions is sufficient for injection molding of a polymer cartridge case.

The polymer compositions can have low density. In an embodiment, the polymer compositions have a specific gravity of less than 1.35, less than 1.3, or less than 1.25 determined in accordance with ASTM D792.

The polymer composition can contain a thermoplastic elastomer. Examples of the polymers in the polymer composition include polycarbonates, polycarbonate copolymers, polysulfones such as polyphenylsulfones, polyphenylsulfone-fluoropolymer copolymers, fluoropolymers, siloxane-polyphenylsulfone copolymers, polyaryletherketone-polyphenysulfone copolymers, polyetherimides, siloxane-polyetherimide copolymers, or a combination comprising at least one of the foregoing.

Preferably the polymer compositions comprise a polycarbonate-polysiloxane copolymer, a siloxane-polyester-polycarbonate copolymer, or a combination comprising at least one of the foregoing.

As used herein the polycarbonate-polysiloxane copolymer (also referred to as poly(carbonate-siloxane)) comprises carbonate units and siloxane units. The carbonate units may be derived from a dihydroxy aromatic compound such as a bisphenol of formula (2) or a diphenol of formula (3)

(2)

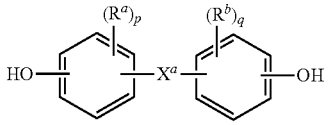

-continued (3)

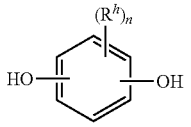

wherein in formula (2) $R^a$ and $R^b$ are each independently $C_{1-12}$ alkyl, $C_{1-12}$ alkenyl, $C_{3-8}$ cycloalkyl, or $C_{1-12}$ alkoxy, p and q are each independently 0 to 4, and $X^a$ is a single bond, —O—, —S—, —S(O)—, —$S(O)_2$—, —C(O)—, a $C_{1-11}$ alkylidene of formula —$C(R^c)(R^d)$— wherein $R^c$ and $R^d$ are each independently hydrogen or $C_{1-10}$ alkyl, or a group of the formula —C(=$R^e$)— wherein $R^e$ is a divalent $C_{1-10}$ hydrocarbon group; and in formula (3), each $R^h$ is independently a halogen atom, for example bromine, a $C_{1-10}$ hydrocarbyl group such as a $C_{1-10}$ alkyl, a halogen-substituted $C_{1-10}$ alkyl, a $C_{6-10}$ aryl, or a halogen-substituted $C_{6-10}$ aryl, and n is 0 to 4.

In some embodiments in formulas (2) and (3), $R^a$ and $R^h$ are each independently $C_{1-3}$ alkyl or $C_{1-3}$ alkoxy, p and q are each independently 0 to 1, and $X^a$ is a single bond, —O—, —S(O)—, —$S(O)_2$—, —C(O)—, a $C_{1-11}$ alkylidene of formula —$C(R^c)(R^d)$— wherein $R^c$ and $R^d$ are each independently hydrogen or $C_{1-10}$ alkyl, each $R^h$ is independently bromine, a $C_{1-3}$ alkyl, a halogen-substituted $C_{1-3}$ alkyl, and n is 0 to 1.

Examples of bisphenol compounds (2) include BPA, 4,4'-dihydroxybiphenyl, 1,6-dihydroxynaphthalene, 2,6-dihydroxynaphthalene, bis(4-hydroxyphenyl)methane, bis(4-hydroxyphenyl)diphenylmethane, bis(4-hydroxyphenyl)-1-naphthylmethane, 1,2-bis(4-hydroxyphenyl)ethane, 1,1-bis(4-hydroxyphenyl)-1-phenylethane, 2-(4-hydroxyphenyl)-2-(3-hydroxyphenyl)propane, bis(4-hydroxyphenyl)phenylmethane, 2,2-bis(4-hydroxy-3-bromophenyl)propane, 1,1-bis (hydroxyphenyl)cyclopentane, 1,1-bis(4-hydroxyphenyl)cyclohexane, 1,1-bis(4-hydroxyphenyl)isobutene, 1,1-bis(4-hydroxyphenyl)cyclododecane, trans-2,3-bis(4-hydroxyphenyl)-2-butene, 2,2-bis(4-hydroxyphenyl)adamantane, alpha, alpha'-bis(4-hydroxyphenyl)toluene, bis(4-hydroxyphenyl)acetonitrile, 2,2-bis(3-methyl-4-hydroxyphenyl)propane, 2,2-bis(3-ethyl-4-hydroxyphenyl)propane, 2,2-bis(3-n-propyl-4-hydroxyphenyl)propane, 2,2-bis(3-isopropyl-4-hydroxyphenyl)propane, 2,2-bis(3-sec-butyl-4-hydroxyphenyl)propane, 2,2-bis(3-t-butyl-4-hydroxyphenyl)propane, 2,2-bis(3-cyclohexyl-4-hydroxyphenyl)propane, 2,2-bis(3-allyl-4-hydroxyphenyl)propane, 2,2-bis(3-methoxy-4-hydroxyphenyl)propane, 2,2-bis(4-hydroxyphenyl)hexafluoropropane, 1,1-dichloro-2,2-bis(4-hydroxyphenyl)ethylene, 1,1-dibromo-2,2-bis(4-hydroxyphenyl)ethylene, 1,1-dichloro-2,2-bis(5-phenoxy-4-hydroxyphenyl)ethylene, 4,4'-dihydroxybenzophenone, 3,3-bis(4-hydroxyphenyl)-2-butanone, 1,6-bis(4-hydroxyphenyl)-1,6-hexanedione, ethylene glycol bis(4-hydroxyphenyl)ether, bis(4-hydroxyphenyl)ether, bis(4-hydroxyphenyl)sulfide, bis(4-hydroxyphenyl)sulfoxide, bis(4-hydroxyphenyl)sulfone, 9,9-bis(4-hydroxyphenyl)fluorene, 2,7-dihydroxypyrene, 6,6'-dihydroxy-3,3,3',3'-tetramethylspiro(bis)indane (spirobiindane bisphenol), 3,3-bis(4-hydroxyphenyl)phthalimide, 2,6-dihydroxydibenzo-p-dioxin, 2,6-dihydroxythianthrene, 2,7-dihydroxyphenoxathin, 2,7-dihydroxy-9,10-dimethylphenazine, 3,6-dihydroxydibenzofuran, 3,6-dihydroxydibenzothiophene, and 2,7-dihydroxycarbazole. A combination comprising different bisphenol compounds can be used.

Examples of diphenol compounds (3) include resorcinol, substituted resorcinol compounds such as 5-methyl resorcinol, 5-ethyl resorcinol, 5-propyl resorcinol, 5-butyl resorcinol, 5-t-butyl resorcinol, 5-phenyl resorcinol, 5-cumyl resorcinol, 2,4,5,6-tetrafluoro resorcinol, 2,4,5,6-tetrabromo resorcinol, or the like; catechol; hydroquinone; substituted hydroquinones such as 2-methyl hydroquinone, 2-ethyl hydroquinone, 2-propyl hydroquinone, 2-butyl hydroquinone, 2-t-butyl hydroquinone, 2-phenyl hydroquinone, 2-cumyl hydroquinone, 2,3,5,6-tetramethyl hydroquinone, 2,3,5,6-tetra-t-butyl hydroquinone, 2,3,5,6-tetrafluoro hydroquinone, 2,3,5,6-tetrabromo hydroquinone, or the like. A combination comprising different diphenol compounds can be used.

In preferred embodiments the carbonate units can be bisphenol carbonate units derived from bisphenols of formula (2). A preferred bisphenol is BPA.

The siloxane units (also referred to as polysiloxane blocks) are optionally of formula (4)

(4)

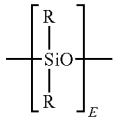

wherein each R is independently a $C_{1-13}$ monovalent organic group. For example, R can be a $C_{1-13}$ alkyl, $C_{1-13}$ alkoxy, $C_{2-13}$ alkenyl, $C_{2-13}$ alkenyloxy, $C_{3-6}$ cycloalkyl, $C_{3-6}$ cycloalkoxy, $C_{6-14}$ aryl, $C_{6-10}$ aryloxy, $C_{7-13}$ arylalkylene, $C_{7-13}$ arylalkylenoxy, $C_{7-13}$ alkylarylene, or $C_{7-13}$ alkylarylenoxy. The foregoing groups can be fully or partially halogenated with fluorine, chlorine, bromine, or iodine, or a combination thereof. In an embodiment, where a transparent poly(carbonate-siloxane) is desired, R is unsubstituted by halogen. Combinations of the foregoing R groups can be used in the same copolymer.

In an embodiment, R is a $C_{1-3}$ alkyl, $C_{1-3}$ alkoxy, $C_{3-6}$ cycloalkyl, $C_{3-6}$ cycloalkoxy, $C_{6-14}$ aryl, $C_{6-10}$ aryloxy, $C_7$ arylalkylene, $C_7$ arylalkylenoxy, $C_7$ alkylarylene, or $C_7$ alkylarylenoxy. In still another embodiment, R is methyl, trifluoromethyl, or phenyl.

The value of E in formula (4) can vary widely depending on the type and relative amount of each component in the polycarbonate compositions, the desired properties of the compositions, and like considerations. Generally, E has an average value of 2 to 500, 2 to 200, 2 to 125, 5 to 100, 5 to 80, 5 to 70. In an embodiment, E has an average value of 20 to 60 or 30 to 50, in still another embodiment, E has an average value of 40 to 50.

In an embodiment, the siloxane units are of formula (5)

(5)

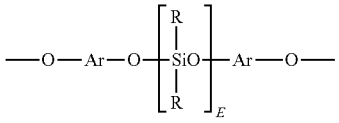

wherein E is as defined above in the context of formula (4); each R can be the same or different and is as defined for formula (4); and Ar can be the same or different and is a substituted or unsubstituted $C_{6-30}$ arylene, wherein the bonds are directly connected to an aromatic moiety. Ar groups in formula (5) can be derived from a $C_{6-30}$ dihydroxyarylene compound, for example a dihydroxy compound of formula (3). Exemplary dihydroxyarylene compounds are 1,1-bis(4-hydroxyphenyl) methane, 1,1-bis(4-hydroxyphenyl) ethane, 2,2-bis(4-hydroxyphenyl) propane, 2,2-bis(4-hydroxyphenyl) butane, 2,2-bis(4-hydroxyphenyl) octane, 1,1-bis(4-hydroxyphenyl) propane, 1,1-bis(4-hydroxyphenyl) n-butane, 2,2-bis(4-hydroxy-1-methylphenyl) propane, 1,1-bis(4-hydroxyphenyl) cyclohexane, bis(4-hydroxyphenyl sulfide), and 1,1-bis(4-hydroxy-t-butylphenyl) propane, or a combination thereof.

Specific examples of siloxane units of formula (5) include those of the formulas (5a) and (5b).

(5a)

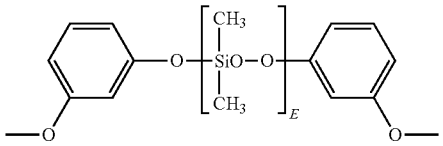

(5b)

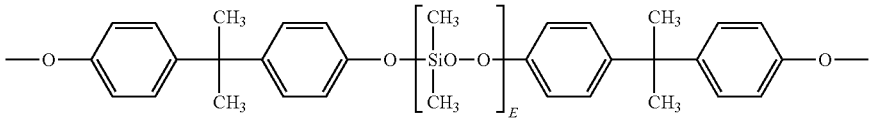

In another embodiment, the siloxane units are of formula (6)

(6)

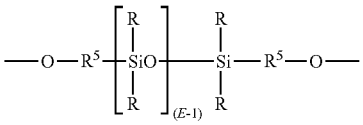

wherein R and E are as described above in the context of formula (4), and each $R^5$ is independently a divalent $C_1$-$C_{30}$ organic group, and wherein the polymerized polysiloxane unit is the reaction residue of its corresponding dihydroxy compound. In a specific embodiment, the polysiloxane blocks are of formula (7)

(7)

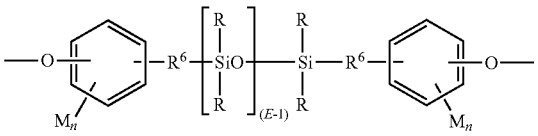

wherein R and E are as defined above in the context of formula (4). $R^6$ in formula (7) is a divalent $C_{2-8}$ aliphatic. Each M in formula (7) can be the same or different, and can be a halogen, cyano, nitro, $C_{1-8}$ alkylthio, $C_{1-8}$ alkyl, $C_{1-8}$ alkoxy, $C_{2-8}$ alkenyl, $C_{2-8}$ alkenyloxy, $C_{3-8}$ cycloalkyl, $C_{3-8}$ cycloalkoxy, $C_{6-10}$ aryl, $C_{6-10}$ aryloxy, $C_{7-12}$ aralkyl, $C_{7-12}$ arylalkylenoxy, $C_{7-12}$ alkylarylene, or $C_{7-12}$ alkylarylenoxy, wherein each n is independently 0, 1, 2, 3, or 4.

In an embodiment, M is bromo or chloro, an alkyl such as methyl, ethyl, or propyl, an alkoxy such as methoxy, ethoxy, or propoxy, or an aryl such as phenyl, chlorophenyl, or tolyl; $R^6$ is a dimethylene, trimethylene or tetramethylene; and R is a $C_{1-8}$ alkyl, haloalkyl such as trifluoropropyl, cyanoalkyl, or aryl such as phenyl, chlorophenyl or tolyl. In another embodiment, R is methyl, or a combination of methyl and trifluoropropyl, or a combination of methyl and phenyl. In still another embodiment, R is methyl, M is methoxy, n is one, and $R^6$ is a divalent $C_{1-3}$ aliphatic group. Specific polysiloxane blocks are of the formula (7a)

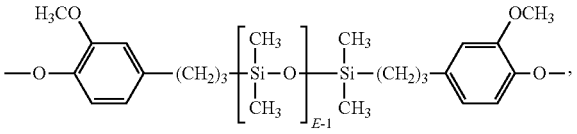

(7b)

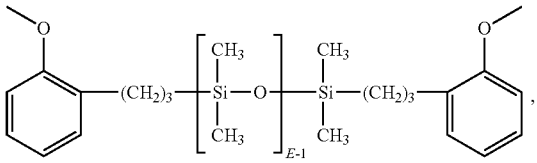

(7c)

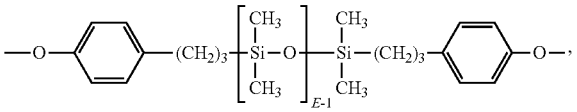

or a combination thereof, wherein E is as defined above in the context of formula (4).

Blocks of formula (7) can be derived from the corresponding dihydroxy polysiloxanes by known methods. The poly(carbonate-siloxane) can be manufactured by introducing phosgene under interfacial reaction conditions into a mixture of bisphenol and an end capped polydimethylsiloxane (PDMS). Other known methods can also be used.

In an embodiment, the polycarbonate-polysiloxane copolymer comprises carbonate units derived from bisphenol A, and repeating siloxane units (5a), (5b), (7a), (7b), (7c), or a combination thereof (preferably of formula 7a), wherein E has an average value of 10 to 100, preferably 20 to 80, or 30 to 70, more preferably 30 to 50 or 40 to 50.

The poly(carbonate-siloxane) can have a siloxane content of 10 to 70 wt %, based on the total weight of the poly (carbonate-siloxane). In some embodiments, the poly(carbonate-siloxane) can have a siloxane content of 10 to 50 wt %, preferably 10 to 40 wt %, 10 to 30 wt %, or 15 to 25 wt %, each based on the total weight of the poly(carbonate-siloxane). As used herein, "siloxane content" of a poly (carbonate-siloxane) means the content of siloxane units based on the total weight of the polysiloxane-polycarbonate copolymer.

The poly(carbonate-siloxane) can be present in the polycarbonate compositions in such an amount that the polymer compositions have a total siloxane content of 0.5 to less than 5 wt %, based on the total weight of the polymer compositions. Without wishing to be bound by theory, it is believed that a total siloxane content of 0.5 to less than 5 wt % contributes to the unique combination of strength, stiffness and ductility at high strain rates of the polymer compositions over a wide temperature range.

Specific siloxane-polyester-polycarbonate copolymers that can be used include poly(ester-carbonate-siloxane)s comprising bisphenol A carbonate units, isophthalate-terephthalate-bisphenol A ester units, and siloxane units as described herein in the context of polycarbonate-polysiloxane copolymer. Commercially available siloxane-polyester-polycarbonate copolymers include those available under the trade name FST from SABIC.

In addition to the polycarbonate-polysiloxane copolymer, the siloxane-polyester-polycarbonate copolymer, or a combination thereof, the polymer compositions can also include a polycarbonate homopolymer such as a bisphenol A polycarbonate homopolymer.

Optionally, the polymer compositions can further include a fluoropolymer such as PFA (perfluoroalkoxy polymers), FEP (fluorinated ethylene propylene polymers), PTFE (polytetrafluoroethylene), PVF (polyvinylfluoride), PVDF (polyvinylidene fluoride), PCTFE (polychlorotrifluoroethylene), ETFE (polyethylenetetrafluoroethylene), ECTFE (polyethylenechlorotrifluoroethylene), perfluoropolyether, or a combination or a co-polymer of any one or more of the foregoing.

In addition, the polymer compositions can include a filler, a reinforcing agent, an antioxidant, a thermal stabilizer, a ultraviolet (UV) stabilizer, a plasticizer, a lubricant, a mold release agent, an antistatic agent, a colorant, a surface effect additive, a radiation stabilizer, an anti-drip agent, a flame retardant, or a combination comprising at least one of the foregoing with the proviso that the additive(s) are selected so as to not significantly adversely affect the desired properties of the polymer compositions, in particular strength, stiffness and ductility at high strain rates and low temperatures. A combination of additives can be used. In general, the additives are used in the amounts generally known to be effective. For example, the total amount of the additives (other than any impact modifier, filler, or reinforcing agents) can be 0.01 to 5 wt %, based on the total weight of the polymer compositions. In an embodiment, the polycarbonate composition comprises no more than 5 wt % based on the weight of the compositions of a processing aid, a heat stabilizer, anti-drip agent, an antioxidant, a colorant, or a combination comprising at least one of the foregoing.

Various types of flame retardants can be utilized. In one embodiment, the flame retardant additives include, for example, flame retardant salts such as alkali metal salts of perfluorinated $C_1$-$C_{16}$ alkyl sulfonates such as potassium perfluorobutane sulfonate (Rimar salt), potassium perfluoroctane sulfonate, tetraethylammonium perfluorohexane sulfonate, potassium diphenylsulfone sulfonate (KSS), and the like, sodium benzene sulfonate, sodium toluene sulfonate (NATS) and the like; and salts formed by reacting for example an alkali metal or alkaline earth metal (for example lithium, sodium, potassium, magnesium, calcium and barium salts) and an inorganic acid complex salt, for example, an oxo-anion, such as alkali metal and alkaline-earth metal salts of carbonic acid, such as $Na_2CO_3$, $K_2CO_3$, $MgCO_3$, $CaCO_3$, and $BaCO_3$ or fluoro-anion complex such as $Li_3AlF_6$, $BaSiF_6$, $KBF_4$, $K_3AlF_6$, $KAlF_4$, $K_2SiF_6$, and/or $Na_3AlF_6$ or the like. Rimar salt and KSS and NATS, alone or in combination with other flame retardants, are particularly useful in the compositions disclosed herein. Specifically mentioned flame retardants include potassium diphenylsulfone sulfonate, sodium toluene sulfonate, potassium perfluorobutane sulphonate, or a combination thereof. Flame retardants can be present in amounts of 0.1 to 1 wt % or 0.1 to 0.5 wt % based on the total weight of the polycarbonate compositions.

The anti-drip agents can be a fibril forming fluoropolymer such as polytetrafluoroethylene (PTFE). The anti-drip agent can be encapsulated by a rigid copolymer as described above, for example styrene-acrylonitrile copolymer (SAN). Encapsulated fluoropolymers and methods of manufacture are known and have been described, for example, in U.S. Pat. Nos. 5,804,654 and 6,040,370. PTFE encapsulated in SAN is known as TSAN. Encapsulated fluoropolymers can be made by polymerizing the encapsulating polymer in the presence of the fluoropolymer, for example an aqueous dispersion. TSAN can provide significant advantages over PTFE, in that TSAN can be more readily dispersed in the composition. An exemplary TSAN can comprise 50 wt % PTFE and 50 wt % SAN, based on the total weight of the encapsulated fluoropolymer. The SAN can comprise, for example, 75 wt % styrene and 25 wt % acrylonitrile based on the total weight of the copolymer. Alternatively, the fluoropolymer can be pre-blended in some manner with a second polymer, such as for, example, an aromatic polycarbonate or SAN to form an agglomerated material for use as an anti-drip agent. Either method can be used to produce an encapsulated fluoropolymer. In an embodiment, the polycarbonate compositions contain 0.1 to 1 wt % or 0.1 to 0.5 wt % of an anti-drip agent based on the total weight of the polycarbonate compositions.

Heat stabilizers can be organophosphites. Organophosphites include triaryl and trialkyl esters of phosphorous acid. Examples of such phosphites are disclosed in H. Zweifel (Ed) *Plastics Additives Handbook,* 5th edition, Hanser Publishers, Munich 2000. Organophosphites can be in liquid and solid form, preferably in solid form. Suitable organophosphites include triaryl esters of phosphorous acid, preferably $C_{1-12}$ alkyl mono-, di- and tri-substituted triaryl esters of phosphorous acid, more preferably trisnonylphenyl phosphite ("TNPP"), tris (2,4-di-tert-butyl)phenyl phosphite ("2,4-DTBP"), or a combination comprising at least one of the foregoing. Also included as solid phosphites are bis(2,4-dicumylphenyl) pentaerythritol diphosphite, bis(2,4-di-tert-butylphenyl) pentaerythritol diphosphite, or a combination comprising at least one of the foregoing. In general, the phosphorus content of the organophosphites is 4 to 15 wt. % preferably 4 to 10 wt. %, based on total organophosphite weight. The organophosphites can be present in amounts of 0.01 to 0.5 wt. %, preferably 0.1 to 0.5 wt. %, based on weight of the polycarbonate compositions.

Examples of suitable UV stabilizers can include benzophenones, triazines, benzoxazinones, benzotriazoles, benzoates, formamidines, cinnamates/propenoates, aromatic propanediones, benzimidazoles, cycloaliphatic ketones, formanilides, cyanoacrylates, benzopyranones, salicylates, and combinations comprising at least one of the foregoing.

The polymer compositions can be molded, extruded, or formed into polymer cartridge cases by a variety of methods, such as injection molding, compression molding, extrusion, rotational molding, blow molding, injection blow molding, stretch blow molding, or thermoforming. As used herein, the polymer cartridge cases include reused or recycled cartridge cases after ammunition articles had been through a single or more firing events.

The polymer cartridge cases can be used to make ammunition articles of various calibers, including .308 caliber, .38 caliber, .5 caliber, 5.56 mm, 7.62 mm, 9 mm, 10 mm, 20 mm, 40 mm, 81 mm, 100 mm, 125 mm, 165 mm, or the like. Advantageously, the metal base insert and the polymer cartridge case remain joined together as a single piece assembly upon loading, firing and removal from a chamber of a firearm for a polymer case temperature of −65° F. (−54° C.) to 165° F. (74° C.).

The above described and other features are exemplified by the following examples.

EXAMPLES

The materials used to construct cartridge cases of ammunition articles for firearms are described in Table 1. Materials used to demonstrate the invention are designated with numbers whereas letters are used to reference comparative examples.

TABLE 1

| Item | Description | Source |
|---|---|---|
| Sample A | Polyphenylsulfone PPSU THERMEC 4250 | Technical Polymers |
| Sample B | Polyetherimide blend ULTEM DU242 | SABIC |
| Sample C | Polyetherimide blend ULTEM DT1810EV | SABIC |
| Sample D | Siloxane-polyetherimide copolymer SILTEM STM1700 | SABIC |
| Sample 1 | Siloxane-polycarbonate copolymer blend THERMOTUF ER007116-BK1A068 | SABIC |
| Sample 2 | Sample 1 filled with 3.5 wt % of milled glass based on the total weight of the sample | SABIC |

Molding Conditions.

A 180-ton injection molding machine with a 5.25 ounce barrel was used to mold ASTM test samples for evaluation of tensile, flexural, notched izod impact and heat deflection temperature (HDT) material properties. The thermoplastic materials of samples 1 and 2 were injection molded with a melt temperature of 305° C. after 8 hours of drying in a dehumidifying dryer at 125° C. to a moisture level of less than 0.02 wt %. A thermolator was used to control the mold surface temperature to 85° C. Screw rotation ranged from 60 to 80 rpm (revolutions per minute) with 0.3 MPa (mega pascal) back pressure without screw decompression after screw recovery. A typical cycle time of 30-32 seconds resulted and was dependent on the ASTM test specimen molded. Materials of samples A-D were molded in a similar fashion with adjustment made for melt and mold temperatures as recommended by the respective supplier.

All molded samples were conditioned for at least 48 hours at 23° C.+/−2° C. and 50+/−5% relative humidity (RH) prior to testing. Samples tested at temperatures other than room temperature were conditioned in a temperature-controlled chamber for at least 6 hours prior to testing.

Material Property Testing Methods.

Tensile properties were measured in accordance with ASTM D638-08 with a speed of 0.2 inch/min (5 mm/min) on a Type I specimen. Tensile elongation (TE) at break, tensile strength (TS) at yield and tensile modulus (TM) were reported as an average of 5 samples.

Tensile properties at high strain rates were measured in accordance with ASTM D638-08 with a speed of 18.9, 189, and 1890 inch/min (480, 4800, or 48000 mm/min) on a Type V specimen at −40° F. (−40° C.), 74° F. (23° C.) and 165° F. (74° C.). Tensile elongation to break, yield strength and modulus were reported as an average of 5 samples at each test condition. Testing was completed by DatapointLabs, Inc.

Flexural properties were measured using ASTM D790-17 standard test method with a 0.125 inch (3.18 mm) thickness test specimen and a rate of 0.05 inch/min (1.27 mm/min). Flexural strength (FS) and flexural modulus (FM) were reported as an average of 5 samples.

Notched Izod impact (NII) properties were measured using ASTM D256-10 standard test method with a 0.125 inch (3.18 mm) thickness test specimen and a pendulum energy of 5.5 lbf/ft. Impact strength was reported as an average of 5 samples. Percent ductility was based on the testing of 5 samples. Ductility was based on the number of test samples that remained as a single test specimen after the testing and was reported as a percentage of the total number of samples tested.

Heat Deflection Temperature (HDT) was measured at 264 psi (1.8 MPa) according to ASTM D648 on a 0.125 inch (3.18 mm) thick un-annealed test sample. HDT was reported as an average of 2 samples.

Specific Gravity was measured in accordance with ASTM D792. Specific gravity was reported as an average of 2 samples.

Dynamic Mechanical Analysis (DMA) properties were measured using ASTM D5026 with izod impact bar as the specimen type and at test temperatures ranging from −112° F. (−80° C.) to 320° F. (160° C.) at a heating rate of 20° C. per minute. Storage Modulus was reported as a function of temperature.

Ammunition Article Firing Test Methods.

The ammunition articles were prepared for firing and comprised of a projectile (bullet), primer and propellant along with the single piece assembly with (.308 caliber) or without (.50 caliber) the presence of a sealant or adhesive. For ammunition articles of .50 caliber, the projectile (bullet) used was M33 Ball 660 gr lead core. The primer used was CCI No 35. The powder used was SMP860 approx 220 gr. For ammunition articles of .308 caliber, the projectile (bullet) used was 7.62×51 cartridge with an M80 ball projectile having a 147 gr lead core and a muzzle velocity of 200 ft/s (61 m/s). The primer used was a CCI #34 primer and propellant used was 40.6 grains of WCR 845 powder. The projectile was provided sufficient propellant to obtain a velocity and pressure comparable to conventional brass ammunition.

Ammunition articles of .50 caliber were fired in a universal receiver (UR) as a single round after being conditioned in a temperature-controlled chamber at the test temperature for a period greater than 4 hours prior to testing. The conditioned temperatures were 68° F. (20° C.) and −20° F. (−28° C.) which defined the polymer cartridge case temperature for which the article were used in the firearm. Upon removal from the temperature-controlled chamber, the articles were immediately loaded and fired. The actual firing event consisted of shooting a single round. Firing results were reported as a fraction with number of successful ammunition articles fired and remained intact without any issues in the numerator with the number of attempts listed as the denominator. The fraction was subsequently converted to a percentage and is referenced by several terms throughout the disclosure such as success rate, pass rate, success percentage, pass percentage, percent success, and survival of firing event or any combination thereof. The success percent and fraction are reported in all tables reporting firing results.

Ammunition articles of .308 caliber were fired in automatic machine guns and were linked together in belts of 50 to 200 rounds and conditioned in a temperature-controlled chamber at the test temperature for a period greater than 4 hours prior to testing. The conditioned temperatures ranged from −65° F. (−54° C.) to 165° F. (74° C.) and defined the polymer cartridge case temperature for which the article were used in the firearm. Upon removal from the temperature-controlled chamber, the articles were immediately loaded and fired in the respective firearm. The actual firing event consisted of shooting bursts of 5-10 rounds in rapid-fire succession until the linked belt was exhausted. Firing results were reported as a fraction with number of successful ammunition articles fired and remained intact without any issues in the numerator with the number of attempts listed as the denominator. The fraction was subsequently converted to a percentage and is referenced by several terms throughout the disclosure such as success rate, pass rate, success percentage, pass percentage, percent success, and survival of firing event or any combination thereof. The success percent and fraction are reported in all tables reporting firing results.

The assessment as to whether an ammunition article was successful and passed or unsuccessful and failed a firing event from a firearm was determined based on the loading, firing and removal of the cartridge from the chamber without interruption of the firing event or subsequent firing events. The removal process includes extraction, ejection or any other process, or combinations thereof, by which a fired ammunition article is removed from the chamber. A failure is defined as interruptions caused by, but not limited to, an ammunition article jammed, fractured, broken, splintered, or any other distortion resulting in stoppage or hesitation of a firing event. A failure is also defined to include any fractures of the polymer case at the gate or knitline for which stoppage did not occur but would affect the performance of the firearm or projectile in reaching the desired velocity or pressure in the firearm. A failure in addition includes light strikes where the ammunition article did not fire because of a problem with the primer upon being struck by the firing pin. There are potentially other failure modes not specifically detailed here and are related to the ammunition article, which result in an unsuccessful firing event and stoppage or hesitation of a firing event. In contrast, an ammunition article that is successful and passes the firing event will do so without a problem with the spent (fired) cartridge and it remains as a single assembly and does not cause disruption, stoppage or hesitation in the operation of a firearm and is without any fractures at the knitline or gate of the polymer case.

Weapon Platforms Used During Testing

As noted above and below, the polymer ammunition articles 100 were fired using various weapons platforms. Each platform is an example of a class of weapon the polymer ammunition articles 100 are designed to be used with.

One weapon system used is the M240 machine gun. The M240 is a general-purpose machine gun that can be mounted on a bipod, tripod, aircraft, or vehicle. The M240 is a belt-fed, air-cooled, gas-operated, fully automatic machine gun that fires from the open bolt position. The M240's max rate of fire is 950 rpm (rounds per minute) with a muzzle velocity of 2,800 ft/s and a maximum range of 3,725 m.

Ammunition is fed into the weapon from a 100-round bandoleer containing a disintegrating metallic split-link belt. The gas from firing one round provides the energy for firing the next round. Thus, the gun functions automatically as long as it is supplied with ammunition and the trigger is held to the rear. As the gun is fired, the belt links separate and are ejected from the side. Empty cases are ejected from the bottom of the gun. The M240 weighs between 22 and 27 pounds and is approximately 50 inches in length. The weapon is chambered to fire 7.62×51 mm caliber cartridges.

The M240 weapon system was chosen for testing because the M240 machine gun's ejection system applies approximately 5 times the ejection force of an AR style semi-automatic rifle and can over torque the insert 200 when extracting the cartridge 100, leading to the insert 200 being pulled from the body 102, leading to jamming. This additional torque produced by the ejector can cause the case to flex during extraction. This flex can lead to jamming of the firearm.

The Mk 48 is a gas-operated, air-cooled, belt-fed machine gun. The weapon is lighter than the M240 but still fires 7.62×51 mm caliber cartridges. The weapon was developed for use by United States Special Operations Command (USSOCOM) units. The Mk 48 is a portable machine gun with the firepower of the M240 and used by the Navy SEALS and Army Rangers. The Mk 48 weighs 18.26 pounds and is almost 40 inches long. The Mk 48's rate of fire is 730 rpm at an effective range of 800 meters.

The US Army M110 Semi-Automatic Sniper System is a semi-automatic medium sniper rifle in use with both regular and special operations forces within the US military. Firing 7.62×51 mm caliber projectiles and weighing in at 15.3 lbs. The M110 has a length of 45.4 inches, a barrel length of 20 inches and a muzzle velocity of 2,571 feet per second. The M110 tested was also suppressed.

A further weapon system used is a Universal Receiver. The Universal Receiver (UR) is a weapon action designed to accommodate common sized barrels in calibers from a .17 caliber up to a .50 caliber BMG. The UR features an open breech face design with a quick access barrel locking nut. In addition to quick change barrels, the universal receiver also has three different firing pins for the varying sized cartridges. The firing pins are sized for the three different primer sizes, small, large and 50 BMG. The firing pins and plate can be changed quickly and easily allowing the user to switch from small caliber pistol testing to large caliber rifle testing in a matter of minutes. The cartridge is manually loaded into the chamber of the barrel, the breech is closed, and the UR is fired by pulling a lanyard. Universal Receivers of this design are utilized across the entire industry to provide a reliable reference system for ammunition testing.

Note that all of the above weapons were chambered for 7.62×51 mm cartridges. 7.62×51 mm caliber cartridges are generally equivalent to .308 caliber cartridges and can generally be used interchangeably. In terms of technical specifications, there are differences between 7.62 and 0.308, but mainly in the chambers of rifles designed to fire each cartridge and not the cartridge itself. The 7.62 cartridge wall is a bit thicker, and commercial .308 is sometimes loaded to slightly higher pressure, but other than that, the cartridges themselves are very similar. For the testing, the cartridges were considered designed to 0.308 standards.

Example 1

Mechanical, thermal and rheological properties of comparative samples A-D and inventive samples 1 and 2 were evaluated, and the results are shown in Table 2.

TABLE 2

| | Material Properties | | | | | |
|---|---|---|---|---|---|---|
| | Sample A | Sample B | Sample C | Sample D | Sample 1 (Invention) | Sample 2 (Invention) |
| | Injection Molded Part Appearance | | | | | |
| | Unfilled Transparent | Unfilled Opaque | Unfilled Transparent | Unfilled Transparent | Unfilled Black | Milled Glass Filled Black |
| TS @ Yield (MPa) | 10.7 (74) | 10.4 (72) | 14.8 (102) | 8.8 (61) | 7.7 (53) | 7.8 (54) |
| TM in Kpsi (MPa) | 333 (2295) | 349 (2405) | 460 (3169) | 348 (2398) | 295 (2033) | 309 (2129) |
| TE @ Break (%) | 96 | 54 | 80 | 40 | 99 | 94 |
| FS in Kpsi (MPa) | 16.7 (115) | 17.3 (119) | 20.1 (138) | 13.6 (94) | 13.1 (90) | 13.3 (92) |
| FM in Kpsi (MPa) | 337 (2322) | 370 (2549) | 480 (3307) | 311 (2143) | 305 (2101) | 318 (2191) |
| HDT (° C.) @ 1.8 MPa | 200 | 151 | 175 | 145 | 122 | 123 |
| Specific Gravity | 1.29 | 1.24 | 1.28 | 1.20 | 1.18 | 1.21 |
| MFR (g/10 min) at 337° C., 6.7 kgf | 9.5 | — | 41 | — | — | — |
| MFR (g/10 min) at 295° C., 6.7 kgf | — | 30 | — | 7 | — | — |
| MFR (g/10 min) at 300° C., 1.2 kgf | — | — | — | — | 8.3 | 9 |

Inventive sample 1 with a tensile yield strength of 7.7 Kpsi (53 MPa) and modulus of 295 Kpsi (2033 MPa) had the least strength and stiffness of all the materials evaluated and was 48% and 56% less than comparative C, respectively. Comparative sample D was similar to inventive sample 1 in yield strength with only a 14% increase while comparative sample A had a tensile modulus that was 13% greater than inventive sample 1. Tensile elongation at break of 99% for inventive sample 1 compared favorably to comparative sample A of 95%, whereas all other unfilled materials ranged from 40 to 80%. The addition of milled glass in inventive sample 2 increased tensile strength or modulus incrementally with a 3% reduction in elongation to break to 96%. In contrast, flexural properties of inventive sample 1 were closely aligned with comparative sample D with flexural strength and modulus of 13.1 (90) and 305 Kpsi (2101 MPa) as compared with 13.6 (94) and 311 Kpsi (2143 MPa). The range in strength and stiffness for inventive samples 1 and 2 was sufficient to provide rigidity to the polymer cartridge case based ammunition article to prevent handling issues in the linked belt or in loading, firing and removal of the spent casings from the firearm. Inventive sample 1 and 2 are the lowest strength and stiffness materials with the highest ductility among the samples tested. This would suggest materials with very low strength and stiffness properties would have interest however if the strength and the stiffness values are too low it would lead to handling issues with excessive flex and/or bend which increase the difficulty in alignment of ammunition articles with the firearm.

The heat deflection temperature (HDT) of the comparative and inventive samples ranged from 252° F. (122° C.) to 392° F. (200° C.) and were sufficient for evaluation in ammunition articles over a range of −65° F. (−55° C.) to 165° F. (74° C.) without deformation. The temperature range represents environmental temperatures for which the ammunition articles may be exposed.

The melt flow rate of each material was sufficient for injection molding of a polymer cartridge case using conditions recommended by the material supplier.

Example 2

The example evaluates a material's resistance to breakage by impact shock as a function of temperature and presence of a defined notch in the test specimen impacted. The failure mode of the impacted specimen was recorded with percent of the total number specimens tested failing in a ductile fashion reported. The notch izod test provides a material's response to a sudden impact, which simulates a pressure burst a polymer cartridge case of an ammunition article would experience during a firing event.

The notched izod impact (NII) properties and percent ductility of comparative samples A through D and inventive samples 1 and 2 were evaluated as a function of temperature. The results are shown in Table 3.

TABLE 3

| | Material Property | | | | | | |
|---|---|---|---|---|---|---|---|
| | Unit | Sample A | Sample B | Sample C | Sample D | Sample 1 (Invention) | Sample 2 (Invention) |
| NII @ 23° C. | Ft-lbf/in | 14.0 | 3.8 | 0.8 | 3.2 | 17.6 | 9.0 |
| Ductility @ 23° C. | % | 100 | 40 | 0 | 20 | 100 | 100 |
| NII @ 0° C. | Ft-lbf/in | 13.5 | 2.5 | 0.5 | 2.1 | 15.6 | 6.2 |
| Ductility @ 0° C. | % | 100 | 0 | 0 | 0 | 100 | 100 |
| NII @ −20° C. | Ft-lbf/in | 12.4 | 2.0 | — | — | 15.5 | 5.9 |
| Ductility @ −20° C. | % | 0 | 0 | | | 100 | 0 |
| NII @ −40° C. | Ft-lbf/in | 12.1 | 2.2 | — | — | 13.4 | — |
| Ductility @ −40° C. | % | 0 | 0 | | | 100 | |
| NII @ −55° C. | Ft-lbf/in | — | — | — | — | 12.1 | — |
| Ductility @ −55° C. | % | | | | | 100 | |

The results in Table 3 show that inventive sample 1 was the most impact resistant and ductile material evaluated at all temperatures with notched izod impact values ranging from 17.6 ft-lbf/in at 74° F. (23° C.) to 12.1 ft-lbf/in at −65° F. (−55° C.) and 100% ductility. The specimens demonstrated superior ductility properties in comparison to all other materials as it remained as a single part after impact and thus did not break into two or more pieces upon completion of the test. The response to the impact event with a ductile failure mode became a significant material property, which correlated well with determining the probability of its success when fired in a firearm at the corresponding temperature. Comparative sample A was also impact resistant with notch izod impact values ranging from a maximum of 14 ft-lbf/in at 74° F. (23° C.) to 12.1 ft-lbf/in at −40° F. (−40° C.). However, test specimens response to the impact event went from demonstrating 100% ductility to 0% failures when the test temperature was reduced to −4° F. (−20° C.) or below. At a low temperature, the test specimens broke into two pieces upon impact even though they retained a relatively high notch izod value from its initial value obtained at room temperature, 23° C. This response, failure mode, to the impact event correlated with the material's inability to survive a firing event at low temperatures and at a success rate equivalent to inventive sample 1. This has been demonstrated and will be discussed hereinafter in example 7. A similar trend for comparative samples B, C and D resulted where notch izod impact values decreased from a maximum initial value obtained at room temperature with the highest percentage of ductile failures to much lower values and 0% ductility as test temperatures were lowered. Materials were excluded from further testing at low temperatures once percent ductility reached 0% since it is well established in literature that resistance to impact reduces with temperature and subsequently become more brittle. Inventive sample 2 reached a maximum NII value of 9 ft-lbf/in at 23° C. and a low NII value of 5.9 ft-lbf/in at −20° C. as a consequence of having milled glass in the otherwise extremely ductile polymer. Ductility of 100% was obtained at room temperature as well as at 32° F. (0° C.).

Notch izod impact results and a materials ability to fail in a ductile fashion at a specific temperature are not the only properties to consider for use in firearm applications since other mechanical and thermal properties are required. These properties, however, suggest where it is not likely to be successful or result in low unacceptable success rates. It is therefore desirable to use a material such as inventive sample 1, which demonstrates a high notch izod impact resistance and 100% ductility over the temperature range of interest.

Example 3

The example evaluates the tensile properties of a material at high strain rates, which more accurately represents conditions during a firing event in a firearm. Firearm pressure increases rapidly and is characterized as reaching 60 Kpsi (413 MPa) in less than 400 milliseconds. This subsequently results in very high strain rates on the polymer cartridge case. The typical strain rates of interest range from 480 to 48000 mm/min, as compared to an ASTM tensile test strains 5 to 50 mm/min for thermoplastic materials. A material's capability to respond to such high strain rates at application temperatures of −40° F. (−40° C.), 74° F. (23° C.) and 165° F. (74° C.) was of interest. Tensile properties of comparative samples A-C and inventive sample 1 at high strain rates were evaluated. The results are summarized in Tables 4A-4I.

TABLE 4A

Tensile Elongation (%) at Break at −40° F. (−40° C.)

| Strain Rate (mm/min) | Sample A | Sample B | Sample C | Sample 1 (Invention) |
|---|---|---|---|---|
| 480 | 61% | 84% | — | 99% |
| 4800 | 68% | 56% | — | 106% |
| 48000 | 56% | 50% | — | 59% |

TABLE 4B

Tensile Elongation (%) at Break at 74° F. (23° C.)

| Strain Rate (mm/min) | Sample A | Sample B | Sample C | Sample 1 (Invention) |
|---|---|---|---|---|
| 480 | 120% | 121% | 103% | 199% |
| 4800 | 93% | 126% | 47% | 195% |
| 48000 | 87% | 95% | 41% | 103% |

TABLE 4C

Tensile Elongation (%) at Break at 165° F. (74° C.)

| Strain Rate (mm/min) | Sample A | Sample B | Sample C | Sample 1 (Invention) |
|---|---|---|---|---|
| 480 | 159% | 188% | — | 193% |
| 4800 | 118% | 170% | — | 150% |
| 48000 | 97% | 140% | — | 84% |

TABLE 4D

Tensile Strength at Yield at −40° F. (−40° C.)—Kpsi (MPa)

| Strain Rate (mm/min) | Sample A | Sample B | Sample C | Sample 1 (Invention) |
|---|---|---|---|---|
| 480 | 13.8 (95.2) | 15.8 (109) | — | 11.1 (76.5) |
| 4800 | 14.8 (102) | 16.7 (115) | — | 11.2 (77.4) |
| 48000 | 15.4 (106) | 17.4 (120) | — | 12.0 (82.4) |

TABLE 4E

Tensile Strength at Yield at 74° F. (23° C.)—Kpsi (MPa)

| Strain Rate (mm/min) | Sample A | Sample B | Sample C | Sample 1 (Invention) |
|---|---|---|---|---|
| 480 | 11.1 (76.5) | 12.0 (82.8) | 17.1 (118) | 8.7 (60.2) |
| 4800 | 11.8 (81.1) | 12.9 (88.8) | 18.4 (127) | 9.3 (64.4) |
| 48000 | 11.8 (81.4) | 13.1 (90.5) | 18.9 (130) | 9.9 (68.1) |

TABLE 4F

Tensile Strength at Yield at 165° F. (74° C.)—Kpsi (MPa)

| Strain Rate (mm/min) | Sample A | Sample B | Sample C | Sample 1 (Invention) |
|---|---|---|---|---|
| 480 | 9.4 (65.0) | 9.6 (66.1) | — | 7.2 (49.4) |
| 4800 | 10.0 (68.6) | 10.3 (70.9) | — | 7.7 (53.2) |
| 48000 | 10.6 (72.7) | 11.7 (80.4) | — | 7.4 (50.9) |

TABLE 4G

| Tensile Modulus at −40° F. (40° C.)—Kpsi (MPa) | | | | |
|---|---|---|---|---|
| Strain Rate (mm/min) | Sample A | Sample B | Sample C | Sample 1 (Invention) |
| 480 | 380 (2620) | 434 (2990) | — | 358 (2470) |
| 4800 | 399 (2750) | 467 (3220) | — | 370 (2550) |
| 48000 | 435 (3000) | 478 (3290) | — | 402 (2770) |

TABLE 4H

| Tensile Modulus at 74° F. (23° C.)—Kpsi (MPa) | | | | |
|---|---|---|---|---|
| Strain Rate (mm/min) | Sample A | Sample B | Sample C | Sample 1 (Invention) |
| 480 | 311 (2140) | 343 (2360) | 435 (3000) | 287 (1980) |
| 4800 | 316 (2180) | 351 (2420) | 446 (3070) | 293 (2020) |
| 48000 | 345 (2380) | 357 (2460) | 456 (3140) | 300 (2070) |

TABLE 4I

| Tensile Modulus at 165° F. (74° C.)—Kpsi (MPa) | | | | |
|---|---|---|---|---|
| Strain Rate (mm/min) | Sample A | Sample B | Sample C | Sample 1 (Invention) |
| 480 | 300 (2070) | 328 (2260) | — | 276 (1900) |
| 4800 | 302 (2080) | 341 (2350) | — | 306 (2110) |
| 48000 | 329 (2270) | 347 (2390) | — | 324 (2230) |

The results in Tables 4A, 4B, and 4C show that tensile elongation at break values increased with temperature while decreased with strain rate. The importance of elongation to break is its relationship with ductility and inference to impact resistance and failure mode. The greater the elongation to break value is, the more ductile the material is. In Table 4A, inventive sample 1 demonstrated elongation to break of 99% with comparative sample B of 84% and sample A of 61% at strain rate of 480 mm/min at −40° F. (−40° C.). As strain rate was increased to 4800 mm/min, inventive sample 1 retained a high elongation to break of 106% followed by comparative samples with the highest at 68% of sample A. It is not until a strain rate of 48000 mm/min was there equivalency among the inventive and comparative samples. These results suggest firing events resulting in strain rates below 48000 mm/min at −40° F. (−40° C.) would result in different success rates between the materials with greatest success being achieved with inventive sample 1. In Table 4B and 4C, test temperature increased to 74° F. (23° C.) and 165° F. (74° C.) and therefore elongation to break values of each material increased with the magnitude of increase dependent on strain rate. These results are important since they suggest that comparative samples A and B would result in a successful firing if the test temperature was increased. In contrast, the elongation to break of comparative sample C at 74° F. (23° C.) remained low and less than 50% at strain rates of 4800 and 48000 mm/min which makes it less likely to work for an ammunition article. It should be understood from the data presented in Tables 4A, 4B and 4C that several materials may work in the application over a limited but not the entire temperature range of −40° F. (−40° C.) to 165° F. (74° C.). Inventive sample 1 is the only material that may achieve success in the application over the entire temperature range evaluated. Finally, it is only the thermoplastic materials which exceed threshold elongation to break value as a function of strain rate and test temperature would be sufficient for use as a polymer ammunition article at temperatures from −40° F. (−40° C.) to 165° F. (74° C.).

The importance of tensile yield strength in the application is that it represents the strength of the material for which is elastic and does not deform permanently. An ammunition article must retain its shape and form throughout the firing event to be successful in the application. However, this is not to imply having a material with the highest yield strength is the most desirable since it generally comes at the expense of elongation to break and subsequently ductility. As presented in Table 4D, 4E, and 4F, tensile yield strength decreased with temperature and increased with strain. Inventive sample 1 had a yield strength ranging from 7.2 to 12.0 Kpsi over the temperature range and strain rate tested whereas comparable samples A, B, and C had yield strengths of 9.4 to 15.4, 9.6 to 17.4 and 17.1 to 18.9 Kpsi respectively. Inventive sample 1 remained as a ductile material under all the test conditions even though its yield strength changed with test conditions. This is in extreme contrast to all comparative materials, which became more brittle as the test conditions became more severe. These results should not be used to suggest having a very low yield strength material is desirable but to suggest there is a range in yield strengths that would be applicable to the application. If a material's yield strength was too low it would permanently deform, and this is not desirable for an ammunition article, as its yield strength would be exceeded during the firing event.

The significance of tensile modulus in the application represents the stiffness of the material, which is necessary in the ammunition article retaining its shape during the loading, firing and removal from the firearm. In addition, the linking of the article in a belt would crush, distort or deform the polymer cartridge case prior to loading in the firearm if the material does not have sufficient stiffness. As presented in Table 4G, 4H, and 4I, tensile modulus decreased with temperature and increased with strain. Tensile modulus of inventive sample 1 ranged from 276 to 402 Kpsi over the temperature range and strain rate tested whereas the tensile modulus of comparable samples A, B, and C ranged from 300 to 435, 328 to 478 and 435 to 456 Kpsi respectively. Inventive sample 1 retained sufficient stiffness for the application whereas all other materials became too stiff with a loss in ductility, as it was apparent in corresponding yield strength for these materials for the application.

Tensile properties reported in Table 4A-I for a large temperature and strain rate range demonstrate the difficulty in defining material properties for which thermoplastic materials will work in the application. Inventive sample 1 demonstrates these properties and has been successful as an ammunition article.

Example 4

Dynamic Mechanical Analyzer (DMA) can be a useful analytical method to measure a material's stiffness over a temperature range for which the ammunition article is to be used. The example compares the storage modulus (stiffness) of comparative sample A and inventive samples 1 and 2, determined by DMA over the temperature range −67° F. (−55° C.) to 165° F. (74° C.). The results are shown in Table 5.

TABLE 5

| Storage Modulus measured by DMA—Kpsi (MPa) | | | |
|---|---|---|---|
| Temperature ° F. (° C.) | Sample A | Sample 1 (Invention) | Sample 2 (Invention) |
| −67 (−55) | 366 (2522) | 265 (1823) | 277 (1908) |
| −40 (−40) | 351 (2415) | 248 (1719) | 261 (1800) |
| 4 (−20) | 333 (2292) | 231 (1592) | 242 (1669) |
| 32 (0) | 319 (2196) | 215 (1484) | 226 (1560) |
| 68 (20) | 307 (2114) | 206 (1417) | 214 (1477) |
| 125 (52) | 285 (1962) | 187 (1285) | 197 (1355) |
| 165 (74) | 262 (1805) | 174 (1200) | 185 (1273) |

The storage modulus, a measure of stiffness, provides significance in the application in a similar fashion as described herein for tensile modulus. Inventive sample 1 storage modulus ranged from 265 to 174 Kpsi at −67° F. (−55° C.) to 165° F. (74° C.) which represents a 34% decrease in material stiffness. The addition of milled glass, inventive sample 2, increased storage modulus at 165° F. (74° C.) by 6.3% from 174 Kpsi levels while increasing cold temperature modulus by 4.5% at −67° F. (−55° C.) as compared to inventive sample 1. This shows that the addition of fillers can be used to increase strength and stiffness of the material at elevated temperatures to improve handling and functionality of the ammunition article in the firearm without an excessive increase of strength and stiffness at low temperatures.

Comparative sample A storage modulus ranged from 366 to 262 Kpsi at −67° F. (−55° C.) to 165° F. (74° C.), which represents a 28% decrease in material stiffness over the entire temperature range. However, the storage modulus may be too high especially at low temperature where a high stiffness is at the consequence of ductility. Compared to sample A, inventive sample 1 has 27.5% and 33.5% less stiffness at the extreme temperature range of −67° F. (−55° C.) to 165° F. (74° C.).

Example 5

The example demonstrates that inventive sample 1 was successfully fired over a temperature range of −20° F. (−28° C.) to 68° F. (20° C.) in a .50 caliber firearm. In addition, the example shows failure rate, type of failure and temperature for which comparative samples A through D were unsuccessful.

TABLE 6

| | Ammo Cartridge Temperature | | |
|---|---|---|---|
| Material | 68° F. (20° C.) | −20° F. (−28° C.) | Comments |
| Sample A | 5/5 (100%) | 3/5 (60%) | Failed at Polymer Case Gate (Crack) |
| Sample B | 5/5 (100%) | 0/2 (0%) | Failed at Polymer Case Gate (Crack) |
| Sample C | Not Tested | 0/2 (0%) | Severe Failure at Polymer Case Gate |
| Sample D | 0/2 (0%) | Not Tested | Failed at knit line of Polymer Case |
| Sample 1 | 5/5 (100%) | 5/5 (100%) | All passed |

The results presented in Table 6 show firing results of inventive sample 1 and comparative samples A through D in a .50 caliber firearm. Inventive sample 1 was 100% successful in firing at all temperatures whereas comparative samples A through D achieved different levels of success with a description of failures listed in the table. Comparative sample A was the most successful of the comparative samples with 100% pass rate at 68° F. (20° C.) but only 60% at −20° F. (−28° C.). The remaining comparable samples performed worse with failures reported at low temperature without any successful trials and comparable sample D failure at 68° F. (20° C.). The results are consistent with the material properties reported in Examples 1 through 4. Inventive sample 1 has the required tensile strength, modulus, elongation to break and type of failure mode over the temperature range and under high strain rates. This describes conditions a material will be exposed so it is expected to perform in such extreme conditions. Finally, it is appreciated that thermoplastic materials not meeting all the required properties for the application may still be functional as an ammunition article over a limited temperature range and in a specific firearm.

Example 6

The example demonstrates that a .308 caliber ammunition article of inventive sample 1 was successfully fired over a temperature range of −65° F. (−55° C.) to 165° F. (74° C.) in M240, Mk48 and M110 firearms. Inventive sample 2 was also tested in a M240 as a .308 caliber at 68° F. (20° C.) to 165° F. (74° C.).

TABLE 7

| | | Ammo Cartridge Temperature | | | |
|---|---|---|---|---|---|
| Material | Firearm | −65° F. (−55° C.) | −40° F. (−40° C.) | 68° F. (20° C.) | 165° F. (74° C.) |
| Sample 1 | M240 | 200/200 (100%) | 400/400 (100%) | 200/200 (100%) | 647/650 (99.5%) |
| Sample 2 | M240 | Not Tested | Not Tested | 10/10 (100%) | 10/10 (100%) |
| Sample 1 | MK48 | 50/50 (100%) | 99/100 (99%) | 150/150 (100%) | 147/150 (98%) |
| Sample 1 | M110/ suppressor | 20/20 (100%) | Not Tested | 20/20 (100%) | 20/20 (100%) |

The results presented in example 6, Table 7 show firing results of inventive sample 1 for a temperature range of −65° F. (−55° C.) to 165° F. (74° C.) in a M240, Mk48 and M110 firearm. The M240 and Mk48 firearms used a belt with linked ammunition of 50 to 100 rounds to feed ammunition articles to the firearm whereas the M110 with suppressor fired 20 round cartridges. The trials with greater number of rounds listed should be understood to consist of a multiple number of linked belts to reach the number of rounds fired. The success rate ranged from 98 to 100% with number of ammunition articles successfully fired presented in the numerator with number attempted in the denominator. Results were also reported as a percentage and are subsequently listed next to the fraction. The ammunition articles loaded, fired, and removed without firearm stoppage or hesitation. The only failures recorded during the trial were light strikes where the primer did not cause the ammunition article to fire. In regards to inventive sample 2, the results demonstrated successful trials at room temperature and an elevated temperature of 165° F. (74° C.) with a success rate of 100% for all articles fired.

Set forth are various Aspects of the disclosure.

Aspect 1. An ammunition article comprising: a polymer cartridge case formed of a polymer composition comprising a thermoplastic polymer, preferably the polymer composition having a density of less than 1.35 determined in accordance with ASTM D792, the polymer cartridge case having a first end, an opposing second end, and a chamber disposed between the first end and the second end for receiving a propellant; a projectile attached to the first end of the polymer cartridge case; a metal base insert joined to the second end of the polymer cartridge case; and a primer carried by the metal base insert; wherein the metal base insert and the polymer cartridge case remain joined together as a single piece assembly upon loading, firing and removal from a chamber of a firearm for a polymer case temperature of −65° F. (−54° C.) to 165° F. (74° C.).

Aspect 2. The ammunition article of Aspect 1, where the polymer composition exhibits one or more of the following tensile elongation to break at −40° F. (−40° C.) based on an ASTM type V tensile bar determined in accordance with ASTM D638-08: greater than 60% at a strain rate of 480 mm/min; greater than 50% at a strain rate of 4800 mm/min; or greater than 40% at a strain rate of 48000 mm/min.

Aspect 3. The ammunition article of any one or more of Aspects 1 to 2, where the polymer composition exhibits one or more of the following tensile elongation to break at 165° F. (74° C.) based on an ASTM type V tensile bar determined in accordance with ASTM D638-08: greater than 150% at a strain rate of 480 mm/min; greater than 100% at a strain rate of 4800 mm/min; or greater than 70% at a strain rate of 48000 mm/min.

Aspect 4. The ammunition article of any one or more of Aspects 1 to 3, where the polymer composition exhibits one or more of the following tensile yield strength based on an ASTM type V tensile bar determined in accordance with ASTM D638-08: greater than 9,000 psi at −40° F. (−40° C.) at a strain rate of 480 mm/min; greater than 7,000 psi at 74° F. (23° C.) at a strain rate of 480 mm/min; or greater than 5,000 psi at 165° F. (74° C.) at a strain rate of 480 mm/min.

Aspect 5. The ammunition article of any one or more of Aspects 1 to 4, where the polymer composition exhibits one or more of the following tensile modulus based on an ASTM type V tensile bar determined in accordance with ASTM D638-08: greater than 300,000 psi at −40° F. (−40° C.) at a strain rate of 480 mm/min; greater than 220,000 psi at 74° F. (23° C.) at a strain rate of 480 mm/min; or greater than 180,000 psi at 165° F. (74° C.) at a strain rate of 480 mm/min.

Aspect 6. The ammunition article of any one or more of Aspects 1 to 5, wherein the polymer composition has a ductility of at least 80% determined in accordance with ASTM D256 with a 0.125 inch (3.18 mm) thickness test specimen and 5.5 lbf/ft pendulum at −40° F. (−40° C.).

Aspect 7. The ammunition article of any one or more of Aspects 1 to 6, wherein the polymer composition has a storage modulus change of less than 45% from −65° F. (−54° C.) to 65° F. (74° C.) at a heating rate of 20° C. per minute as measured using a Dynamic Mechanical Analyzer in accordance with ASTM D5026 on an izod impact bar.

Aspect 8. The ammunition article of any one or more of Aspects 1 to 7, wherein the polymer composition has a heat deflection temperature of greater than 230° F. (110° C.) determined in accordance with ASTM D648 at 264 psi (1.8 MPa) with a un-annealed sample having a thickness of 0.125 inch (3.18 mm).

Aspect 9. The ammunition article of any one or more of Aspects 1 to 8, wherein the polymer composition comprises a thermoplastic elastomer.

Aspect 10. The ammunition article of any one or more of Aspects 1 to 9, wherein the polymer composition comprises a polycarbonate, polycarbonate copolymer, a polysulfone, a polyphenylsulfone-fluoropolymer copolymer, a fluoropolymer, a siloxane-polyphenylsulfone copolymer, a polyaryletherketone-polyphenysulfone copolymer, a polyetherimide, a siloxane-polyetherimide copolymer, or a combination comprising at least one of the foregoing.

Aspect 11. The ammunition article of any or more of Aspects 1 to 10, wherein the polymer composition comprises a polycarbonate-polysiloxane copolymer, a siloxane-polyester-polycarbonate copolymer, or a combination comprising at least one of the foregoing, optionally in combination with a fluoropolymer.

Aspect 12. The ammunition article of Aspect 11, wherein the polycarbonate-polysiloxane copolymer, the siloxane-polyester-polycarbonate copolymer, or both have siloxane units of the formula (5a), (5b), (7a), (7b), (7c), or a combination thereof, wherein E has an average value of 5 to 100, preferably siloxane units of the formula (7c) wherein E has an average value of 20 to 80, or 30 to 70.

Aspect 13. The ammunition article of Aspect 12, wherein the polycarbonate-polysiloxane copolymer has a siloxane content of 10 to 50 wt % based on the total weight of the polycarbonate-polysiloxane, and optionally the polycarbonate-polysiloxane copolymer is present in an amount effective to provide a siloxane content of 0.3 to less than 5 wt % based on the total weight of the polymer composition.

Aspect 14. The ammunition article of any one or more of Aspects to 13, wherein the polymer composition further comprises a filler, a reinforcing agent, an antioxidant, a heat stabilizer, a UV stabilizer, a plasticizer, a lubricant, a mold release agent, an antistatic agent, a colorant, a surface effect additive, a radiation stabilizer, an anti-drip agent, a flame retardant, or a combination comprising at least one of the foregoing.

Aspect 15. The ammunition article of any one or more of Aspects 1 to 14, wherein the polymer cartridge case is a reused or recycled cartridge case after the ammunition article had been through a single or more firing events.

Aspect 16. The ammunition article of any one or more of Aspects 1 to 15, wherein the polymer cartridge case is an injection molded, compression molded, extruded, blow molded, a rotational molded, an injection blow molded, stretch blow molded, or thermoformed cartridge case.

The singular forms "a," "an," and "the" include plural referents unless the context clearly dictates otherwise. "Or" means "and/or" unless clearly indicated otherwise by context. The endpoints of all ranges directed to the same component or property are inclusive and independently combinable (e.g., ranges of "less than or equal to 25 wt %, or to 20 wt %," is inclusive of the endpoints and all intermediate values of the ranges of "5 to 25 wt %," etc.). Disclosure of a narrower range or more specific group in addition to a broader range is not a disclaimer of the broader range or larger group.

"Optional" or "optionally" means that the subsequently described event or component may or may not occur, and that the description includes instances where the event occurs and instances where it does not. Unless defined otherwise, technical and scientific terms used herein have the same meaning as is commonly understood by one of skill in the art to which this disclosure belongs. A "combination" is inclusive of blends, mixtures, alloys, reaction products, and the like. "A combination thereof" is an open term that includes at least one of the listed elements, optionally together with one or more equivalent elements not listed.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

While typical embodiments have been set forth for illustration, the foregoing descriptions should not be deemed to be a limitation on the scope herein. Accordingly, various modifications, adaptations, and alternatives can occur to one skilled in the art without departing from the spirit and scope herein.

What is claimed is:

1. An ammunition article comprising:

a polymer cartridge case formed of a polymer composition comprising a thermoplastic polymer, the polymer cartridge case having a first end, an opposing second end, and a chamber disposed between the first end and the second end for receiving a propellant;

a projectile attached to the first end of the polymer cartridge case;

a metal base insert joined to the second end of the polymer cartridge case; and a primer carried by the metal base insert;

wherein the polymer composition comprises a polycarbonate-polysiloxane copolymer present in such an amount that the polymer composition has a total siloxane content of 0.5 to less than 5 wt %, based on the total weight of the polymer composition; and wherein the metal base insert and the polymer cartridge case remain joined together as a single piece assembly upon loading, firing and removal from a chamber of a firearm for a polymer case temperature of −65° F. (−54° C.) to 165° F. (74° C.).

2. The ammunition article of claim 1, where the polymer composition exhibits one or more of the following tensile elongation to break at −40° F. (−40° C.) based on an ASTM type V tensile bar determined in accordance with ASTM D638-08:

greater than 60% at a strain rate of 480 mm/min;

greater than 50% at a strain rate of 4800 mm/min; or greater than 40% at a strain rate of 48000 mm/min.

3. The ammunition article of claim 1, where the polymer composition exhibits one or more of the following tensile elongation to break at 165° F. (74° C.) based on an ASTM type V tensile bar determined in accordance with ASTM D638-08:

greater than 150% at a strain rate of 480 mm/min;

greater than 100% at a strain rate of 4800 mm/min; or greater than 70% at a strain rate of 48000 mm/min.

4. The ammunition article of claim 1, where the polymer composition exhibits one or more of the following tensile yield strength based on an ASTM type V tensile bar determined in accordance with ASTM D638-08:

greater than 9,000 psi at −40° F. (−40° C.) at a strain rate of 480 mm/min;

greater than 7,000 psi at 74° F. (23° C.) at a strain rate of 480 mm/min; or greater than 5,000 psi at 165° F. (74° C.) at a strain rate of 480 mm/min.

5. The ammunition article of claim 1, where the polymer composition exhibits one or more of the following tensile modulus based on an ASTM type V tensile bar determined in accordance with ASTM D638-08:

greater than 300,000 psi at −40° F. (−40° C.) at a strain rate of 480 mm/min;

greater than 220,000 psi at 74° F. (23° C.) at a strain rate of 480 mm/min; or greater than 180,000 psi at 165° F. (74° C.) at a strain rate of 480 mm/min.

6. The ammunition article of claim 1, wherein the polymer composition has a ductility of at least 80% determined in accordance with ASTM D256 with a 0.125 inch (3.18 mm) thickness test specimen and 5.5 lbf/ft pendulum at −40° F. (−40° C.).

7. The ammunition article of claim 1, wherein the polymer composition has a storage modulus change of less than 45% from −65° F.(−54° C.) to 65° F.(74° C.) at a heating rate of 20° C. per minute as measured using a Dynamic Mechanical Analyzer in accordance with ASTM D5026 on an izod impact bar.

8. The ammunition article of claim 1, wherein the polymer composition has a heat deflection temperature of greater than 230° F. (110° C.) determined in accordance with ASTM D648 at 264 psi (1.8 MPa) with a un-annealed sample having a thickness of 0.125 inch (3.18 mm).

9. The ammunition article of claim 1, wherein the polymer composition further comprises a polycarbonate homopolymer, polycarbonate copolymer other than the polycarbonate-polysiloxane copolymer, a polysulfone, a polyphenylsulfone-fluoropolymer copolymer, a fluoropolymer, a siloxane-polyphenylsulfone copolymer, a polyaryletherketone-polyphenysulfone copolymer, a polyetherimide, a siloxane-polyetherimide copolymer, or a combination comprising at least one of the foregoing.

10. The ammunition article of claim 1, wherein the polymer composition comprises a combination of the polycarbonate-polysiloxane copolymer and a siloxane-polyester-polycarbonate copolymer.

11. The ammunition article of claim 1, wherein the polycarbonate-polysiloxane copolymer has siloxane units of the formula

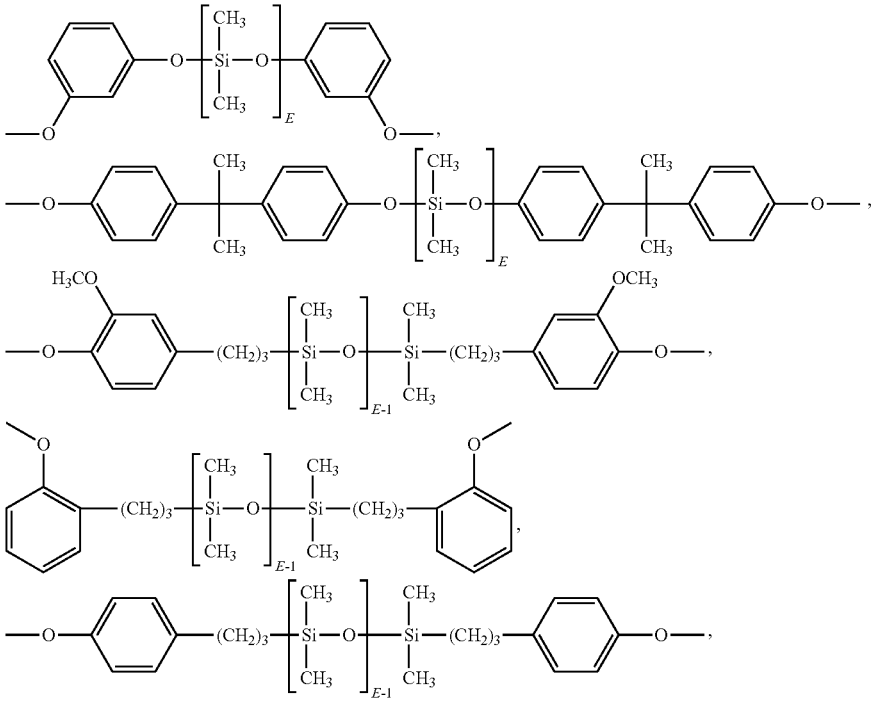

or a combination thereof, wherein E has an average value of 5 to 100.

12. The ammunition article of claim 11, wherein the polycarbonate-polysiloxane copolymer has a siloxane content of 10 to 50 wt % based on the total weight of the polycarbonate-polysiloxane.

13. The ammunition article of claim 12, wherein the polymer composition further comprises a filler, a reinforcing agent, an antioxidant, a heat stabilizer, a UV stabilizer, a plasticizer, a lubricant, a mold release agent, an antistatic agent, a colorant, a surface effect additive, a radiation stabilizer, an anti-drip agent, a flame retardant, or a combination comprising at least one of the foregoing.

14. The ammunition article of claim 1, wherein the polymer cartridge case is a reused or recycled cartridge case after the ammunition article had been through a single or more firing events.

15. The ammunition article of claim 1, wherein the polymer cartridge case is an injection molded, compression molded, extruded, blow molded, a rotational molded, an injection blow molded, stretch blow molded, or thermoformed cartridge case.

16. The ammunition article of claim 1, wherein the polymer composition having a density of less than 1.35 determined in accordance with ASTM D792.

17. The ammunition article of claim 1, wherein the polycarbonate-polysiloxane copolymer has siloxane units of the formula

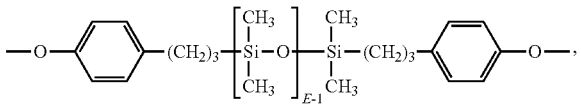

wherein E has an average value of 20 to 80.

18. The ammunition article of claim 1, wherein the polymer composition further comprises a fluoropolymer.

19. The ammunition article of claim 18, wherein the fluoropolymer comprises a perfluoroalkoxy polymer, a fluorinated ethylene propylene polymer, a polytetrafluoroethylene, a polyvinylfluoride, a polyvinylidene fluoride, a polychlorotrifluoroethylene, a polyethylenetetrafluoroethylene, a polyethylenechlorotrifluoroethylene, a perfluoropolyether, or a combination or a co-polymer of any one or more of the foregoing.

* * * * *